US010926130B2

(12) United States Patent
Yoo et al.

(10) Patent No.: US 10,926,130 B2
(45) Date of Patent: Feb. 23, 2021

(54) NONPOWERED TREADMILL

(71) Applicant: DRAX INC., Anyang-si (KR)

(72) Inventors: Seon Kyung Yoo, Seoul (KR); Jae Sang Park, Seongnam-si (KR)

(73) Assignee: DRAX INC., Anyang-si (KR)

( * ) Notice: Subject to any disclaimer, the term of this patent is extended or adjusted under 35 U.S.C. 154(b) by 34 days.

(21) Appl. No.: 16/272,784

(22) Filed: Feb. 11, 2019

(65) Prior Publication Data

US 2019/0168066 A1 Jun. 6, 2019

Related U.S. Application Data

(63) Continuation of application No. PCT/KR2017/009054, filed on Aug. 18, 2017.

(30) Foreign Application Priority Data

Aug. 19, 2016 (KR) ..... 10-2016-0105746

(51) Int. Cl.
*A63B 22/02* (2006.01)
*A63B 24/00* (2006.01)
(Continued)

(52) U.S. Cl.
CPC ..... *A63B 22/02* (2013.01); *A63B 24/0087* (2013.01); *A63B 23/1227* (2013.01);
(Continued)

(58) Field of Classification Search
CPC ..... A63B 24/0087; A63B 2220/30; A63B 2022/0278; A63B 2024/0093;
(Continued)

(56) References Cited

U.S. PATENT DOCUMENTS 6,416,444 B1 * 7/2002 Lim ..... A63B 24/00 482/51
7,141,006 B1 * 11/2006 Chen ..... A63B 22/02 482/54
(Continued)

FOREIGN PATENT DOCUMENTS

CN 202087004 U 12/2011
CN 203315649 U 12/2013
(Continued)

OTHER PUBLICATIONS

Machine translation of description of JP11253573 from ESPACENET (Year: 1999).*
(Continued)

*Primary Examiner* — Jennifer Robertson
*Assistant Examiner* — Catrina A Letterman
(74) *Attorney, Agent, or Firm* — Knobbe Martens Olson & Bear LLP

(57) ABSTRACT

Provided is a nonpowered treadmill driven by a user's foot motion. The nonpowered treadmill includes a track part, a rotation unit rotatably supporting the track part, a detector configured to detect a rotation speed of the track part, and a resistance controller configured to control a rotation resistance of the track part in response to the rotation speed detected by the detector.

14 Claims, 10 Drawing Sheets

(51) Int. Cl.
*A63B 71/06* (2006.01)
*A63B 23/12* (2006.01)

(52) U.S. Cl.
CPC ... *A63B 71/0619* (2013.01); *A63B 2022/0278* (2013.01); *A63B 2024/0093* (2013.01); *A63B 2220/30* (2013.01); *A63B 2220/34* (2013.01); *A63B 2220/50* (2013.01)

(58) Field of Classification Search
CPC ..... A63B 2022/0271; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 2220/31; A63B 2220/34; A63B 2220/36; A63B 22/02–0292
See application file for complete search history.

(56) References Cited

U.S. PATENT DOCUMENTS

| | | | | |
|---|---|---|---|---|
| 10,016,656 | B2 * | 7/2018 | Devor | A63B 22/02 |
| 2006/0160669 | A1 * | 7/2006 | Lizarralde | A63B 21/0051 482/63 |
| 2010/0210418 | A1 * | 8/2010 | Park | A63B 22/025 482/4 |
| 2012/0184409 | A1 * | 7/2012 | Beal | A63B 23/1209 482/5 |
| 2015/0352400 | A1 | 12/2015 | Bayerlein et al. | |
| 2016/0023039 | A1 | 1/2016 | Cei | |
| 2017/0136289 | A1 * | 5/2017 | Frank | A63B 24/0087 |
| 2018/0001134 | A1 * | 1/2018 | Bayerlein | A63B 21/0058 |

FOREIGN PATENT DOCUMENTS

| | | | | |
|---|---|---|---|---|
| CN | 204655886 | U | | 9/2015 |
| CN | 204972842 | U | | 1/2016 |
| CN | 105288940 | A | | 2/2016 |
| CN | 105797311 | A | | 7/2016 |
| JP | 8-103513 | A | | 4/1996 |
| JP | 11-253573 | A | | 9/1999 |
| JP | 11253573 | | * | 9/1999 |
| KR | 2004-0082517 | A | | 9/2004 |
| KR | 10-2012-0051825 | | | 5/2012 |
| KR | 10-1315516 | E1 | | 10/2013 |
| KR | 10-2016-0061161 | A | | 5/2016 |

OTHER PUBLICATIONS

Office Action of corresponding Korean Patent Application No. 10-2016-0105746—5 pages (dated May 31, 2017).
Office Action of corresponding Korean Patent Application No. 10-2016-0105746—3 pages (dated Feb. 27, 2018).
Office Action of corresponding Korean Patent Application No. 10-2016-0105746—3 pages (dated May 29, 2018).
International Search Report of corresponding Patent Application No. PCT/KR2017/009054—4 pages (dated Nov. 27, 2017).
Office Action dated Mar. 31, 2020 in Chinese Application No. 201780050868.4, in 16 pages.

* cited by examiner

NONPOWERED TREADMILL

CROSS-REFERENCE TO RELATED APPLICATIONS

This application is a continuation application and claims the benefit under 35 U.S.C. §§ 120 and 365 of PCT Application No. PCT/KR2017/009054, filed on Aug. 18, 2017, which is hereby incorporated by reference. PCT/KR2017/009054 also claimed priority from Korean Patent Application No. 10-2016-0105746 filed on Aug. 19, 2016 which is hereby incorporated by reference.

BACKGROUND

Technical Field

The present disclosure relates to a treadmill, and more particularly, to a nonpowered treadmill driven by a user's foot motion.

Related Technology

Treadmills are exercise machines that give the effect of walking or running exercise in a small space using a track part rotating along an infinite orbit, and are also called running machines. The demand for treadmills is ever increasing because treadmills allow users to walk or run indoors at suitable temperatures, regardless of the weather.

Treadmills may be classified into powered treadmills, in which a track part is rotated by a separate driving means, e.g., a motor, and nonpowered treadmills, in which a track part is rotated by a user's foot motion without a separate driving means.

Since nonpowered treadmills have a structure in which a track part is rotated not by a motor but by a user's foot motion, the rotation speed of the track part is basically determined by the user's speed.

However, the maximum speed of the track part and the smoothness of rotation of the track part may vary with the rotation resistance of the track part. For example, the rotation resistance of the track part may be decreased to increase the maximum speed of the track part and to allow the track part to smoothly rotate.

However, when the rotation resistance of the track part is decreased, the track part may be slippery or rotate fast unintentionally at a low speed. Accordingly, a user may feel uncomfortable when the user starts an exercise or is doing an exercise at a low speed.

SUMMARY

Provided is a nonpowered treadmill which gives a user a sense of stability at a low speed and the naturalness of a motion at a high speed.

According to an aspect of the present disclosure, a nonpowered treadmill is driven by a user's foot motion.

The nonpowered treadmill includes: a track part; a rotation unit rotatably supporting the track part; a detector configured to detect a rotation speed of the track part; and a resistance controller configured to control a rotation resistance of the track part in response to the rotation speed detected by the detector.

The resistance controller may decrease the rotation resistance of the track part when the rotation speed of the track part increases.

An upper portion of the track part may have a curved shape.

The resistance controller may apply a variable force to at least one of the rotation unit and the track part in an opposite direction to a rotation direction of the track part while the track part is rotating.

The rotation resistance of the track part may be equal to or less than 2.0 kg force when the resistance controller applies no force.

The rotation resistance of the track part may be equal to or less than 1.0 kg force when the resistance controller applies no force.

The resistance controller may linearly decrease the rotation resistance of the track part.

The resistance controller may remove the variable force when the rotation speed of the track part is greater than a reference speed.

The rotation unit may include a plurality of first rotating members located in a front portion and a rear portion; and a plurality of second rotating members arranged between the plurality of first rotating members and having a smaller diameter than the plurality of first rotating members.

The track part may include a plurality of slats extending in a direction perpendicular to a rotation direction of the rotation unit.

The nonpowered treadmill may further include a frame structure supporting the rotation unit, wherein the plurality of second rotating members may be arranged in a curved line in an upper portion of the frame structure.

Other aspects, features, and advantages than those described above will be clear from the accompanying drawings, the claims, and the description of embodiments below.

These general and specific aspects may be embodied using a system, a method, a computer program, or a combination thereof.

As described above, a nonpowered treadmill according to embodiments changes a frictional resistance of a track part by providing a force varying with a rotation speed of the track part, thereby giving a user a sense of stability at a low speed and the naturalness of a motion at a high speed.

DETAILED DESCRIPTION

Hereinafter, the configuration of a nonpowered treadmill according to an embodiment will be described with reference to the attached drawings. In the description of embodiments, certain detailed explanations of the functions or configurations of the related art are omitted to clarify the essence of the present disclosure.

Figure 1:
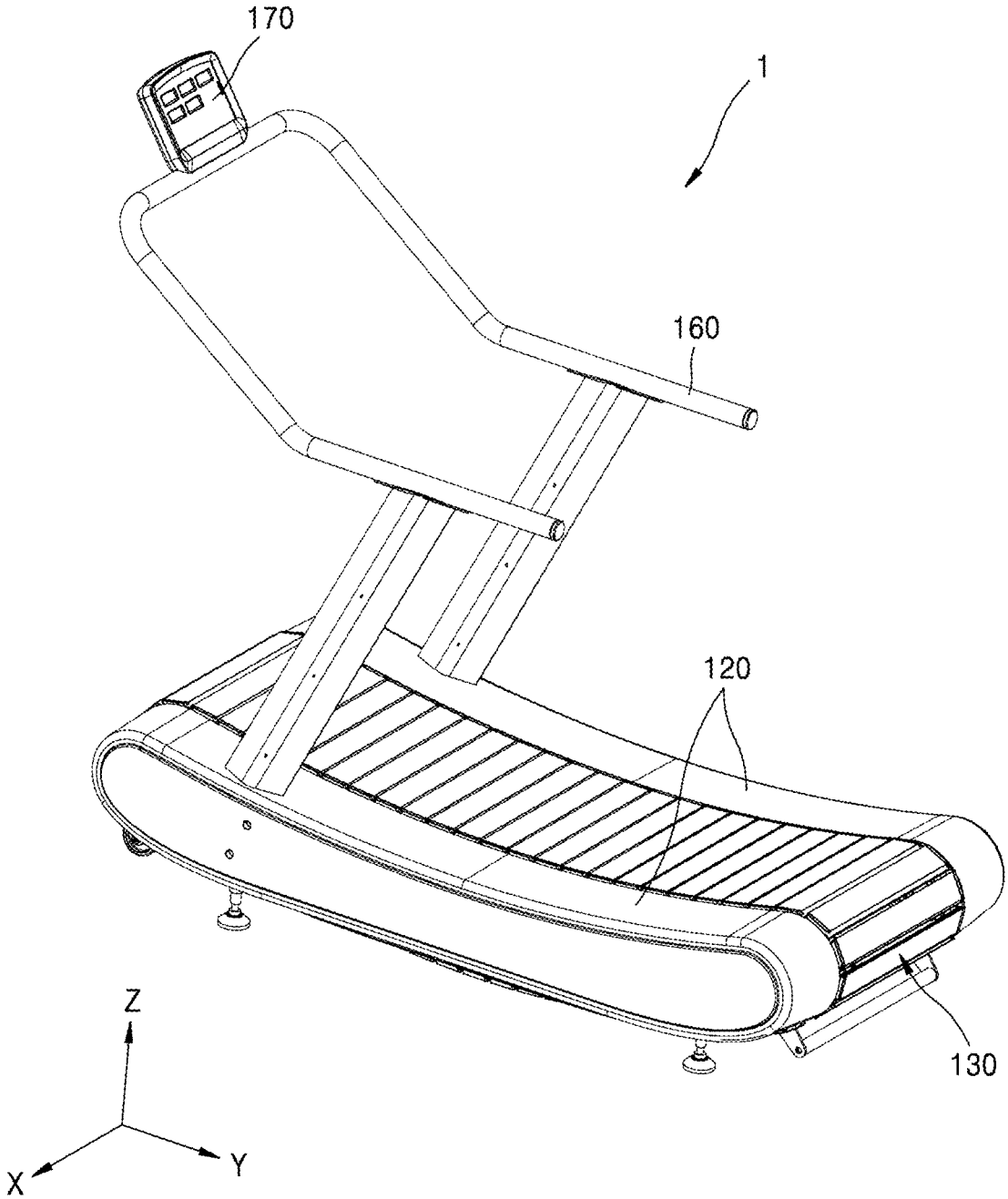
FIG. 1 is a perspective view of a nonpowered treadmill according to an embodiment.
Figure 2:
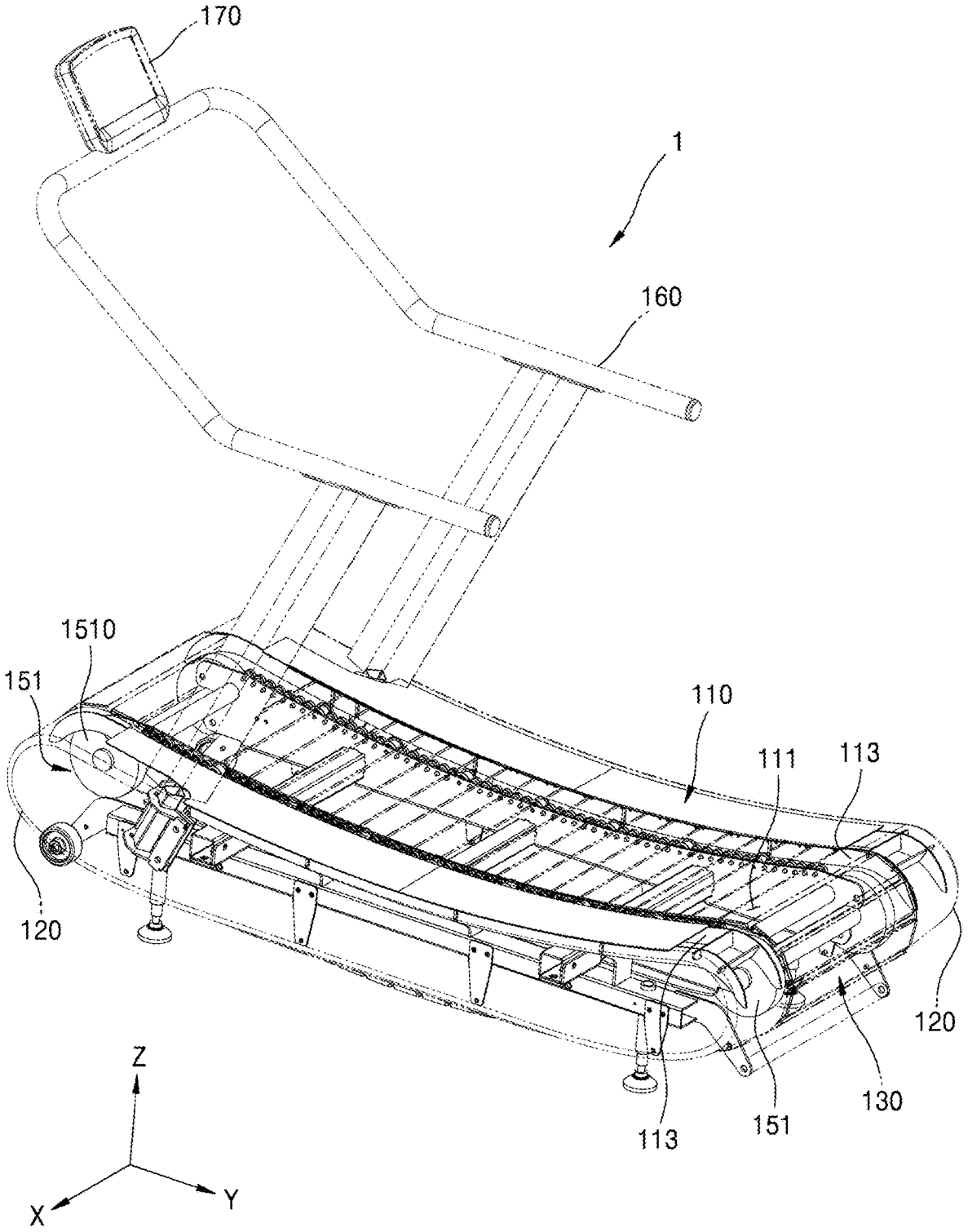
FIG. 2 is a perspective view illustrating an inner structure of the nonpowered treadmill of FIG. 1.
Figure 3A:
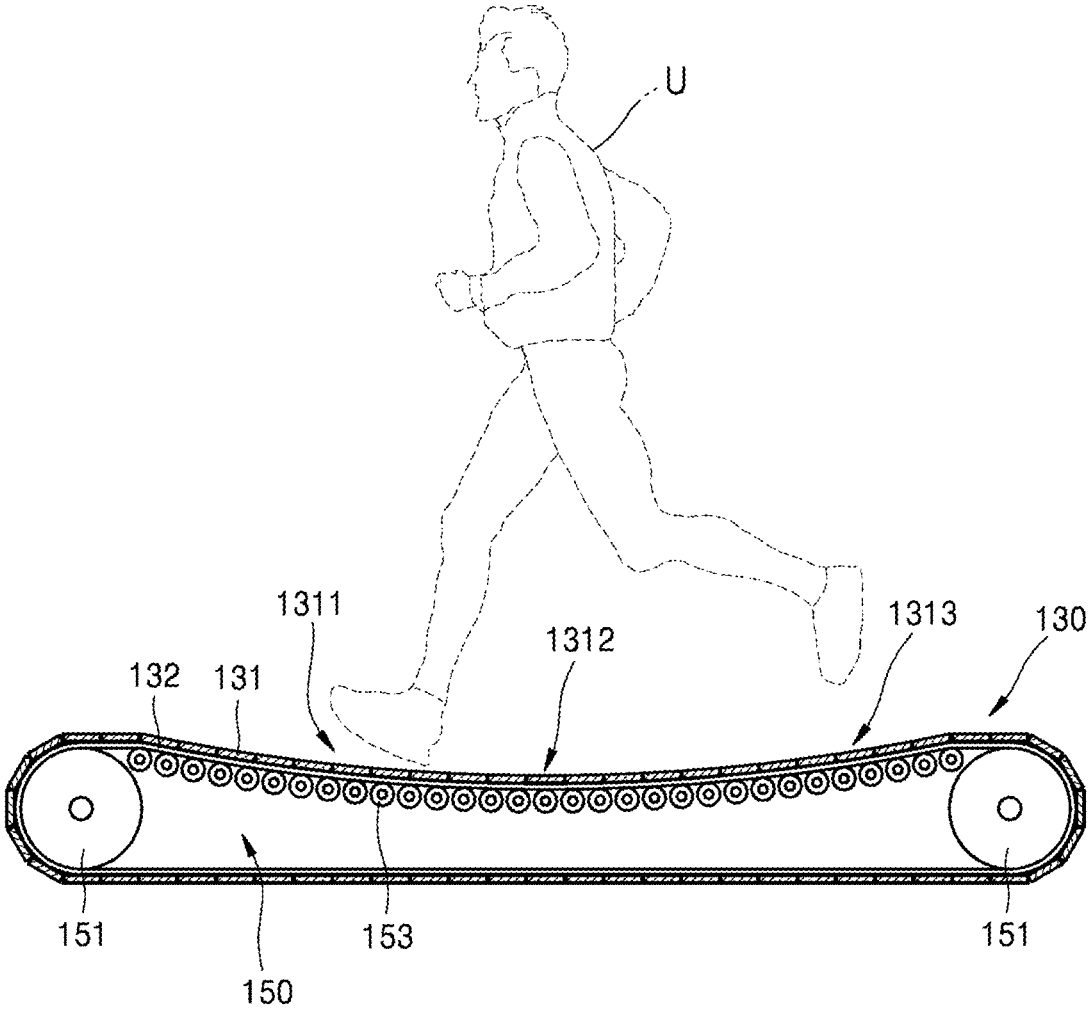
FIGS. 3A and 3B are cross-sectional views of the nonpowered treadmill of FIG. 1 viewed from different angles.
Figure 3B:
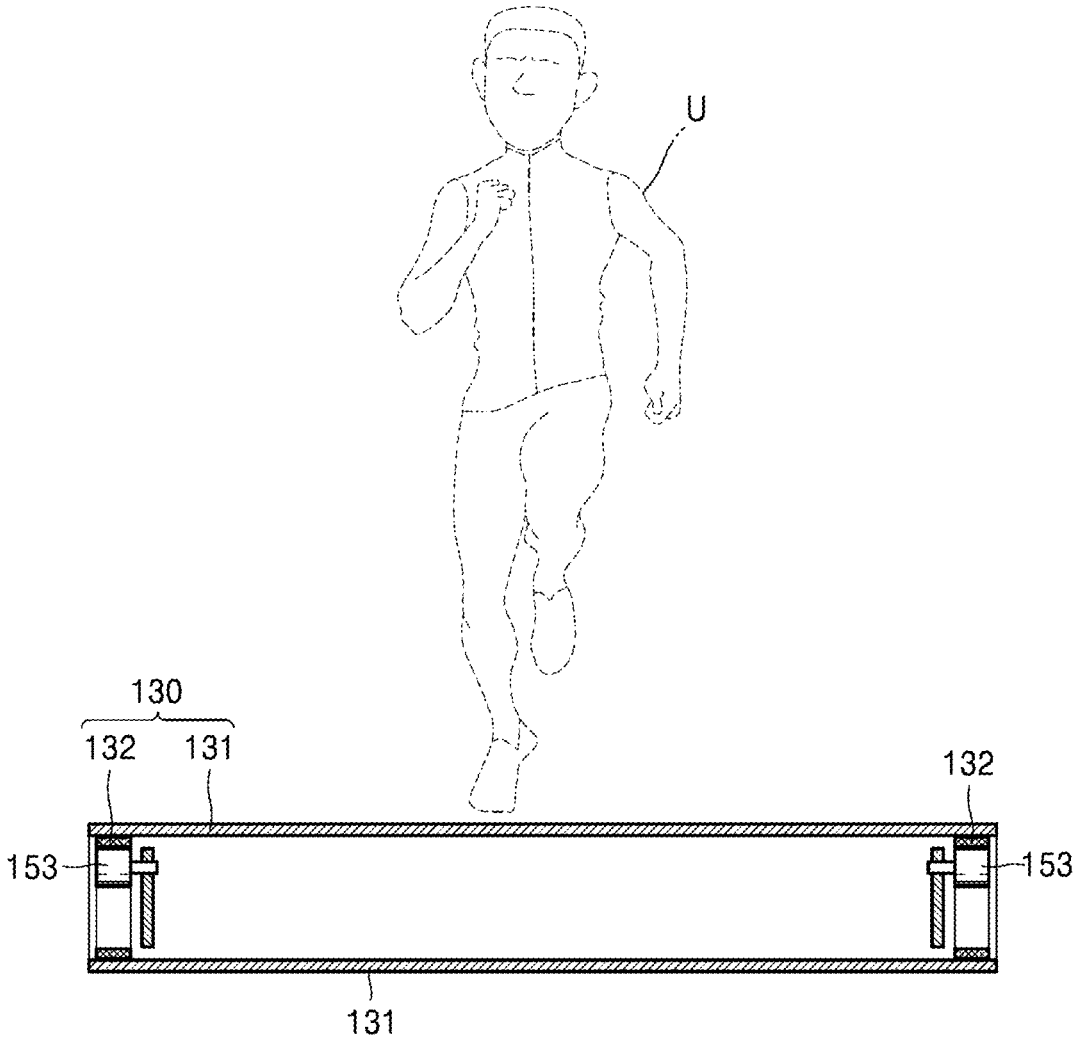

FIG. 1 is a perspective view of a nonpowered treadmill 1 according to an embodiment. FIG. 2 is a perspective view illustrating an inner structure of the nonpowered treadmill 1 of FIG. 1. FIGS. 3A and 3B are cross-sectional views of the nonpowered treadmill 1 of FIG. 1 viewed from different angles.

Referring to FIGS. 1, 2, 3A, and 3B, a track part 130 is driven by a foot motion of a user U in the nonpowered treadmill 1, and the nonpowered treadmill 1 does not include a driving unit rotating the track part 130.

The nonpowered treadmill 1 includes a frame structure 110, the track part 130 rotatable with respect to the frame structure 110, and a rotation unit 150 rotatably supporting the track part 130. The nonpowered treadmill 1 may further include a handle portion 160, which the user U may grip on to, and an output unit 170 showing an exercise result.

The frame structure 110 maintains the shape of the nonpowered treadmill 1 and includes a central frame 111 and a side frame 113 at each of both sides of the central frame 111. The side frame 113 may be covered with a side cover 120.

The rotation unit 150 includes a first rotating member 151 and a plurality of second rotating members 153 having a smaller diameter than the first rotating member 151.

The first rotating member 151 may be located in each of front and rear portions. For example, the first rotating member 151 may be located in each of the front and rear portions of the central frame 111.

The first rotating member 151 may include a pair of pulleys 1510 arranged separated from each other in a direction perpendicular to a rotation direction.

The second rotating members 153 may be arranged between a plurality of first rotating members 151 respectively located in the front and rear portions. For example, the second rotating members 153 may be arranged in the central frame 111 between the first rotating members 151. The second rotating members 153 may be arranged in a curved line in an upper portion of the central frame 111. The curved line may be concave in the middle. The second rotating members 153 may be ball bearings for rotating a belt 132 of the track part 130, as described below.

The track part 130 may include a plurality of slats 131. The slats 131 are arranged close to each other in the rotation direction of the track part 130. Each of the slats 131 extends in a direction, e.g., an X direction, perpendicular to the rotation direction of the track part 130.

The slats 131 are connected to each other by a connecting member, e.g., the belt 132. The slats 131 connected by the belt 132 form a closed loop.

When the user U makes a foot motion on the track part 130, a force moving the track part 130 toward the rear portion is applied to the track part 130. Since the track part 130 is rotatably supported by the first rotating members 151 respectively located in the front and rear portions and the second rotating members 153 arranged between the first rotating members 151, the track part 130 is rotated by the foot motion of the user U, as described above.

In the nonpowered treadmill 1 described above, the track part 130 rotates fast when the user U runs fast and rotates slowly when the user U runs slowly. The track part 130 stops when the user U stops.

For example, a top area of the track part 130 may include a front region 1311, a reference region 1312, and a rear region 1313. The slope of each of the front region 1311 and the rear region 1313 may increase away from the reference region 1312.

When the user U steps on the front region 1311, a force applied by the user U to the track part 130 increases, and accordingly, the rotation speed of the track part 130 also increases. When the user U steps on the rear region 1313, a force is applied to the track part 130 in an opposite direction to the rotation direction of the track part 130, and accordingly, the rotation speed of the track part 130 decreases.

As described above, the user U exercises on the track part 130 which rotates in accordance with the running speed of the user U, thereby spontaneously controlling the speed without an additional operation. Accordingly, the user U may perform an exercise more actively.

Since the nonpowered treadmill 1 has a structure in which the track part 130 is rotated not by a motor but by a foot motion of the user U, the maximum speed of the track part 130 and the smoothness of rotation of the track part 130 vary with the rotation resistance of the track part 130. Here, the rotation resistance of the track part 130 is defined as a force which acts in the opposite direction to the rotation direction of the track part 130 in a procedure in which the track part 130 is rotated by the foot motion of the user U.

When the rotation resistance of the track part 130 increases, the maximum rotation speed of the track part 130 decreases and the rotation of the track part 130 may not be smooth at a high speed.

In this regard, the nonpowered treadmill 1 may be designed such that the rotation resistance of the track part 130 is low. For example, the nonpowered treadmill 1 may be designed such that the rotation resistance of the track part 130 is equal to or less than 2.0 kg force. More desirably, the nonpowered treadmill 1 may be designed such that the rotation resistance of the track part 130 is equal to or less than 1.0 kg force. Accordingly, the maximum rotation speed of the track part 130 of the nonpowered treadmill 1 is increased and the track part 130 may smoothly rotate at a high speed.

However, when the rotation resistance of the track part 130 is low in all speed ranges, the track part 130 may be slippery or rotate fast unintentionally at a low speed. Accordingly, the user U may feel uncomfortable when the user U starts an exercise or is doing an exercise at a low speed on the nonpowered treadmill 1.

In this regard, provided is a nonpowered treadmill 100 which gives a user a sense of stability by increasing the rotation resistance of the track part 130 at a low speed and gives the user the naturalness of a motion by decreasing the rotation resistance of the track part 130 at a high speed.

Figure 4:
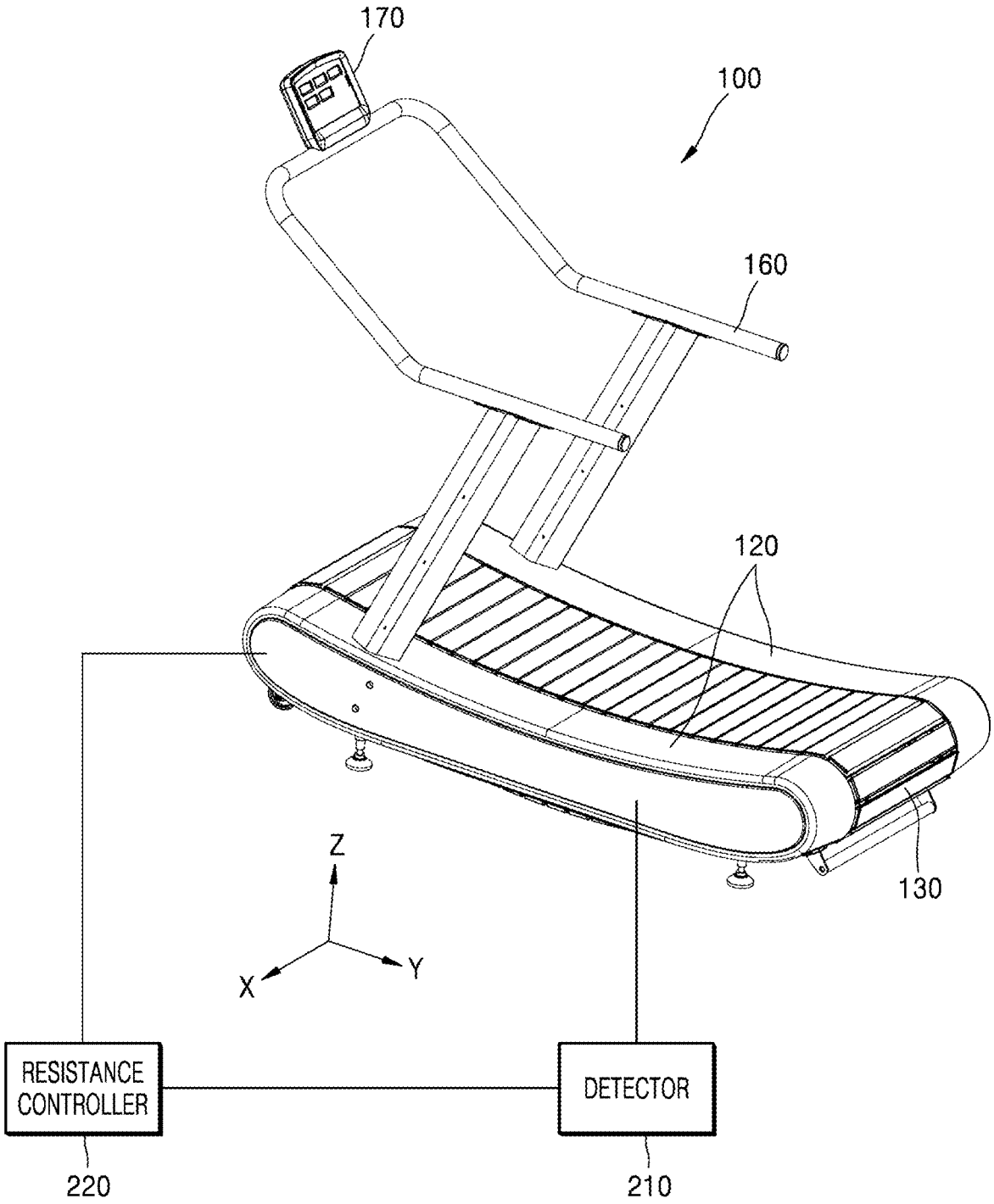
FIG. 4 is a diagram schematically illustrating a nonpowered treadmill according to an embodiment.
Figure 5:
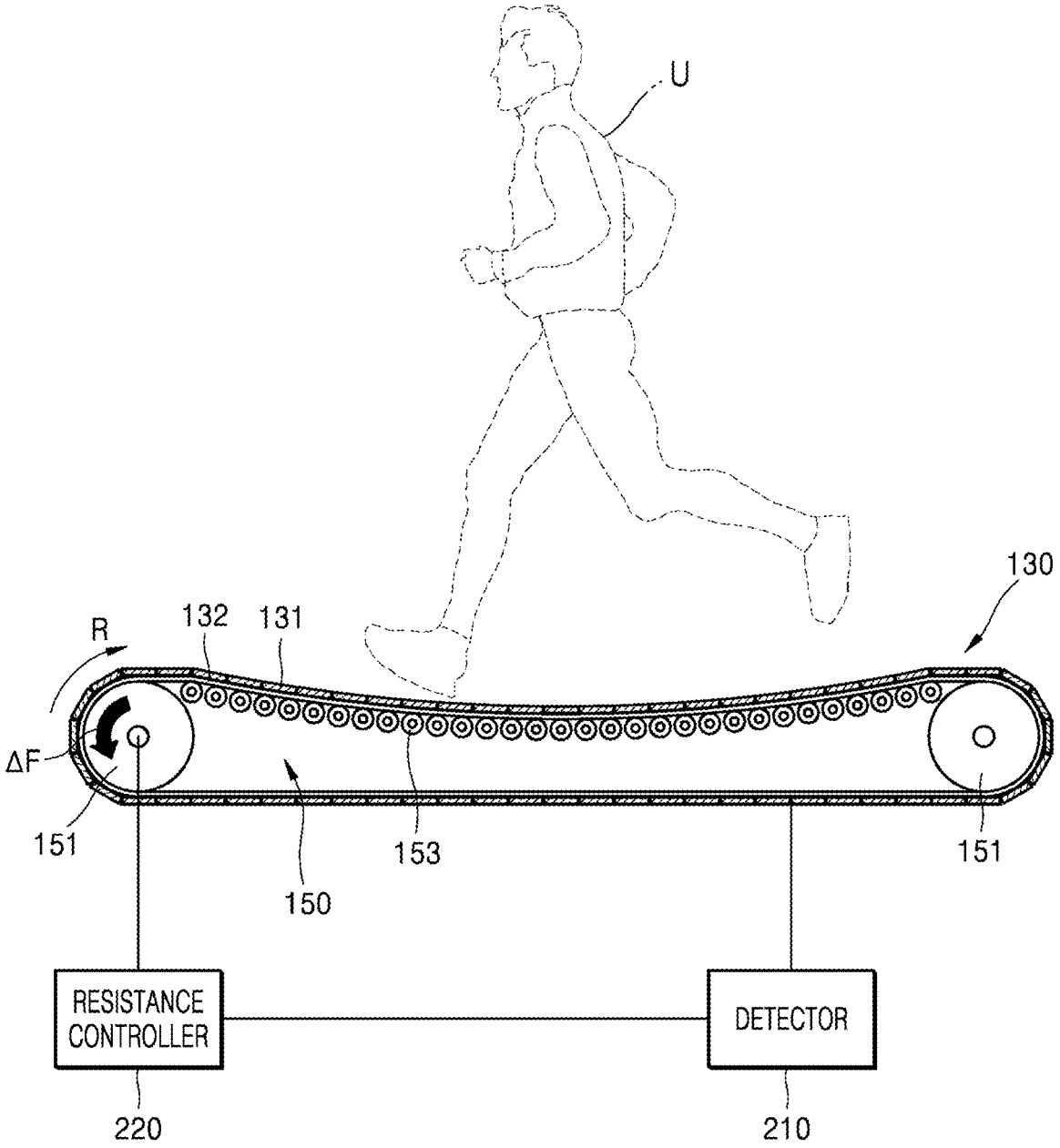
FIG. 5 is a diagram of an example of the nonpowered treadmill of FIG. 4.

FIG. 4 is a diagram schematically illustrating the nonpowered treadmill 100 according to an embodiment. FIG. 5 is a diagram of an example of the nonpowered treadmill 100 of FIG. 4.

Referring to FIG. 4, the nonpowered treadmill 100 further includes a detector 210 configured to detect the rotation speed of the track part 130 and a resistance controller 220 controlling the rotation resistance of the track part 130 in addition to the frame structure 110, the rotation unit 150, and the track part 130 in FIGS. 1 and 2.

To detect the rotation speed of the track part 130, the detector 210 may detect the rotation speed of the track part 130 itself or the rotation speed of the rotation unit 150 rotated by the track part 130.

However, a detection principle of the detector 210 is not limited to the description above and may be variously changed if only the rotation speed of the track part 130 can be detected. For example, it is apparent that the detector 210 may detect a location of the user U and detect the rotation speed of the track part 130.

The resistance controller 220 controls the rotation resistance of the track part 130 in response to the rotation speed of the track part 130, which is detected by the detector 210. For example, as the rotation speed of the track part 130 increases, the resistance controller 220 may decrease the rotation resistance of the track part 130.

To control the rotation resistance of the track part 130, the resistance controller 220 may apply a variable force ΔF to at least one of the rotation unit 150 and the track part 130 in the opposite direction of the rotation direction of the track part 130. The variable force ΔF may be an electric force or a magnetic force but is not limited thereto. The variable force ΔF may be a mechanical force.

For example, the resistance controller 220 may vary the force ΔF applied to the rotation unit 150 in the opposite direction of the rotation direction of the track part 130, as shown in FIG. 5.

As the rotation speed of the track part 130 increases, the resistance controller 220 may decrease a force, which is applied to the rotation unit 150, under the condition of a speed equal to or lower than a reference speed and may remove the force applied to the rotation unit 150 under the condition of a speed which is equal to or higher than the reference speed.

Here, the reference speed may be a maximum walking speed of the user U. For example, the reference speed may be equal to or less than 7 km/h. However, the reference speed is not limited thereto and may be variously changed. For example, the reference speed may be a speed at which the user U starts to walk, e.g., 3 km/h or less. In another example, the reference speed may be a maximum speed which the user U can achieve on the track part 130, e.g., 30 km/h or less.

Figure 6:
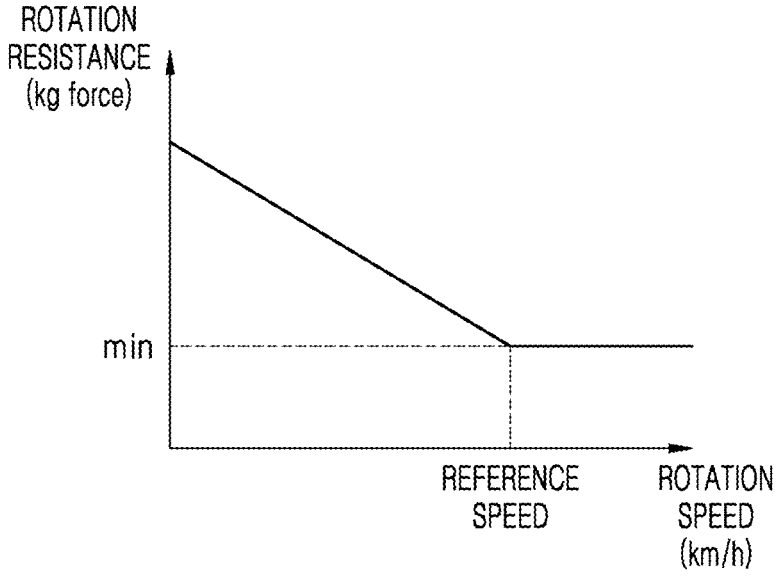
FIG. 6 is a graph of an example in which the rotation resistance of a track part changes as the rotation speed of the track part increases when a resistance controller in FIG. 4 operates.
Figure 7A:
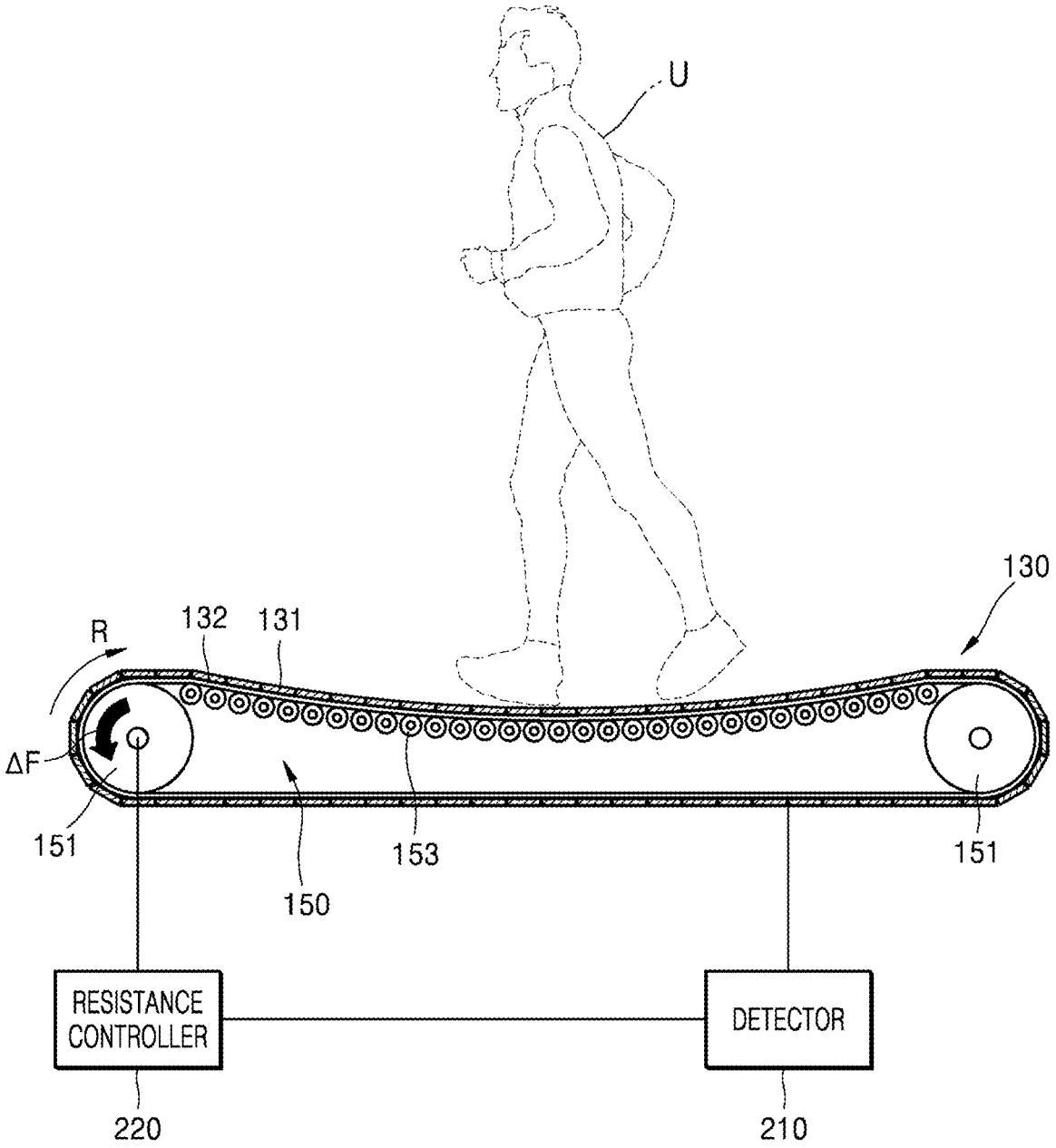
FIGS. 7A and 7B are diagrams for explaining operations of the resistance controller when the rotation speed of the track part is high and when the rotation speed of the track part is low.
Figure 7B:
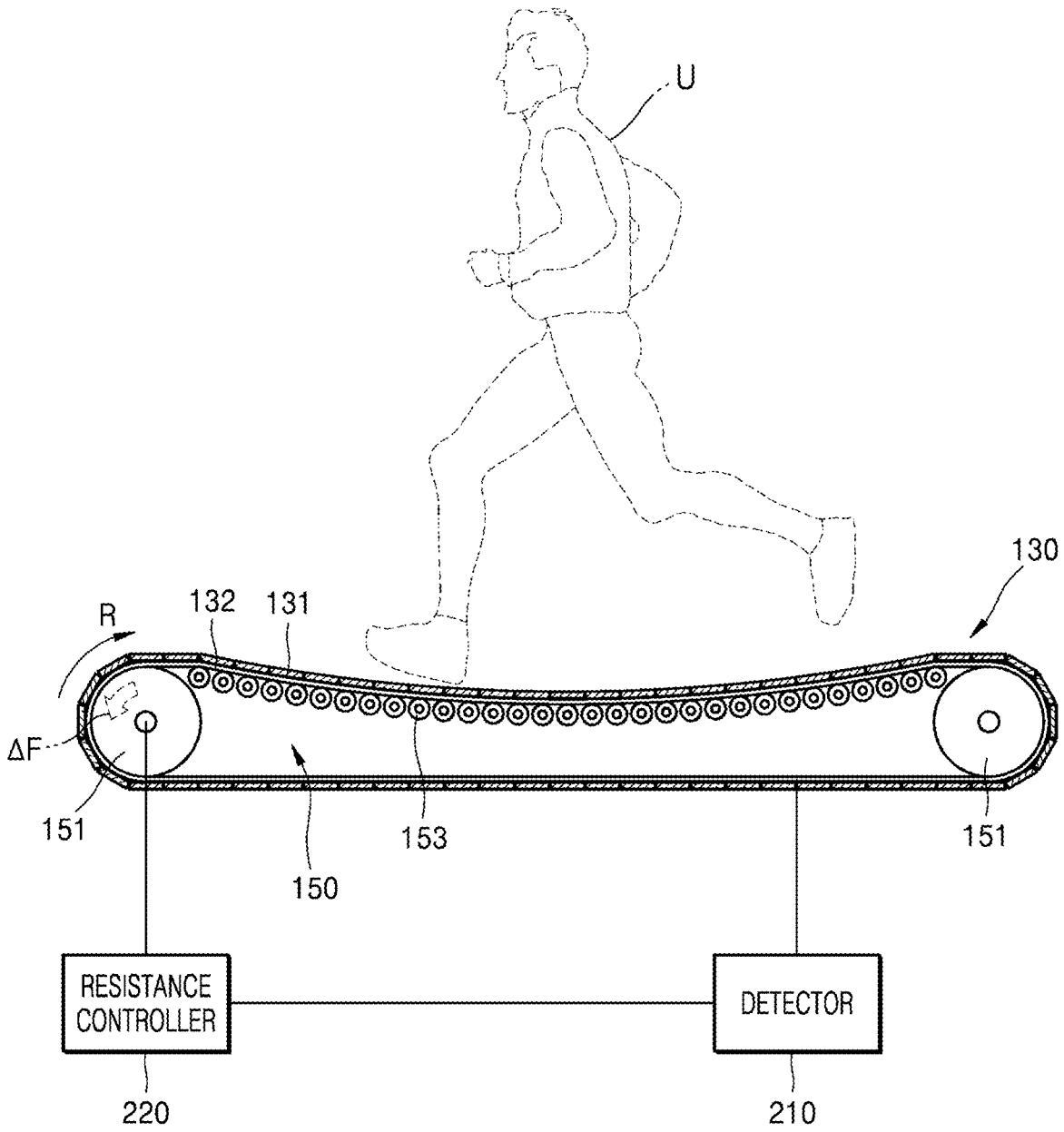

FIG. 6 is a graph of an example in which the rotation resistance of the track part 130 changes as the rotation speed of the track part 130 increases when the resistance controller 220 operates. FIGS. 7A and 7B are diagrams for explaining operations of the resistance controller 220 when the rotation speed of the track part 130 is high and when the rotation speed of the track part 130 is low.

Referring to FIG. 6, as the rotation speed of the track part 130 increases, the resistance controller 220 may decrease the rotation resistance of the track part 130 under the condition of a speed equal to or lower than the reference speed and may maintain the rotation resistance of the track part 130 at a minimum rotation resistance "min" under the condition of a speed which is equal to or higher than the reference speed.

The minimum rotation resistance "min" of the track part 130 may be the rotation resistance of the track part 130 which appears when the force ΔF applied by the resistance controller 220 in the opposite direction of the rotation direction of the track part 130 is not present. The minimum rotation resistance "min" of the track part 130 may be equal to or less than 2.0 kg force. Desirably, the minimum rotation resistance "min" of the track part 130 may be equal to or less than 1.0 kg force.

Referring to FIGS. 6 and 7A, when the rotation speed of the track part 130 is low, for example, when the user U starts walking on the track part 130, the force ΔF greater than a certain level is applied by the resistance controller 220 to the rotation unit 150 in an opposite direction of a rotation direction R of the track part 130. Accordingly, the rotation resistance of the track part 130 is greater than the minimum rotation resistance "min".

Referring to FIGS. 6 and 7B, when the rotation speed of the track part 130 is high, for example, when the user U is running on the track part 130, the force ΔF applied to the rotation unit 150 in the opposite direction of the rotation direction R of the track part 130 is removed by the resistance controller 220. Accordingly, the rotation resistance of the track part 130 may be the minimum rotation resistance "min".

As described above, while the track part 130 is rotating at a low speed, a rotation resistance greater than a certain level is applied to the track part 130, and therefore, the user U may be relieved from uncomfortable feeling which may be caused by the slipperiness of the track part 130 at the low speed. In addition, while the track part 130 is rotating at a high speed, a rotation resistance applied to the track part 130 is minimized, and therefore, the track part 130 may be rotated smoothly at the high speed.

Meanwhile, a mode for decreasing the rotation resistance of the track part 130 using the resistance controller 220 may be various.

In an embodiment, the resistance controller 220 may continuously decrease the rotation resistance of the track part 130 according to an increase in the rotation speed of the track part 130, which is detected. For example, the resistance controller 220 may linearly decrease the rotation resistance of the track part 130, as shown in FIG. 6, under the condition of a speed equal to or lower than the reference speed.

Figure 8A:
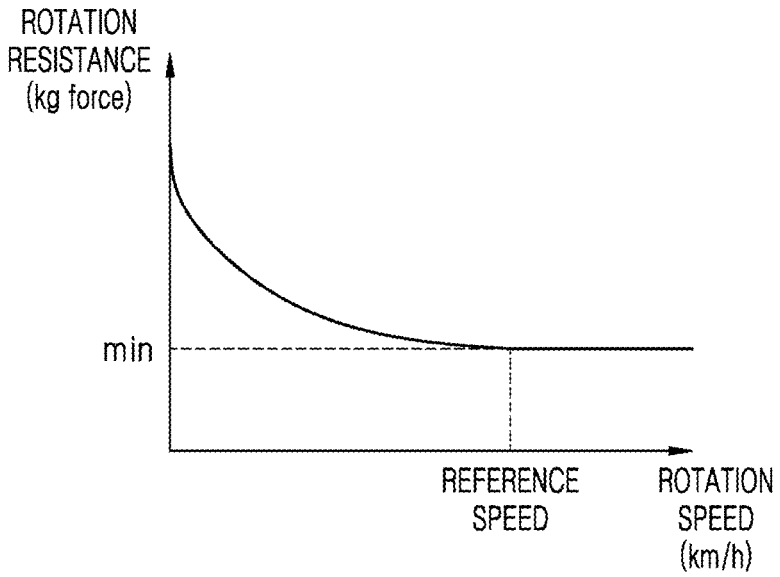
FIGS. 8A and 8B are graphs of modifications of FIG. 6.

In another example, the resistance controller 220 may nonlinearly decrease the rotation resistance of the track part 130, as shown in FIG. 8A, under the condition of a speed equal to or lower than the reference speed.

Figure 8B:
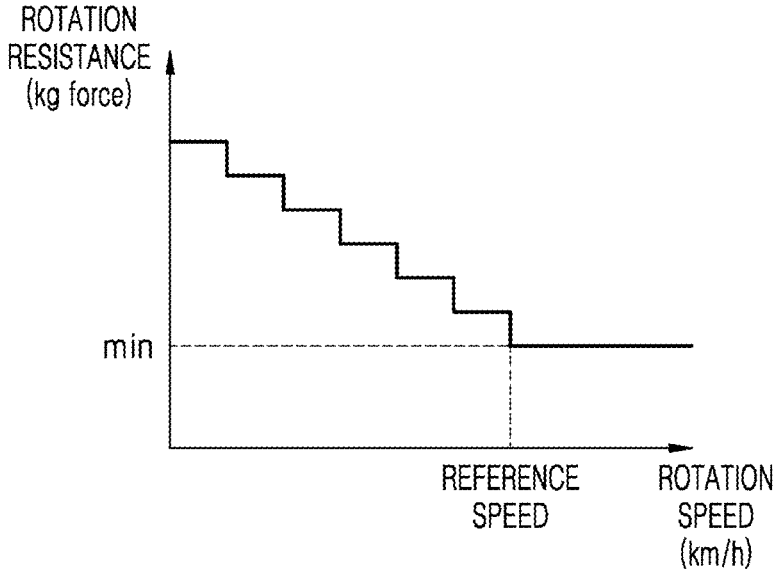

In another embodiment, the resistance controller 220 may discontinuously decrease the rotation resistance of the track part 130 according to an increase in the rotation speed of the track part 130, which is detected. For example, the resistance controller 220 may stepwise decrease the rotation resistance of the track part 130, as shown in FIG. 8B, under the condition of a speed equal to or lower than the reference speed.

Although example embodiments have been described above, the scope of the present disclosure is not limited to these embodiments, and the embodiments may be properly changed without departing from the scope of the claims.

Other aspects, features, and advantages than those described above will be clear from the accompanying drawings, the claims, and the description of embodiments below. These general and specific aspects may be embodied using a system, a method, a computer program, or a combination thereof.

What is claimed is:

1. A nonpowered treadmill driven by a user's foot motion, the nonpowered treadmill corn pri sing:

a track part;

a rotation unit rotatably supporting the track part;

a detector configured to detect a rotation speed of the track part; and a resistance controller configured to control a rotation resistance of the track part in response to the rotation speed detected by the detector, the resistance controller further configured to decrease the rotation resistance of the track part as the rotation speed of the track part increases.

2. The nonpowered treadmill of claim 1, wherein an upper portion of the track part has a curved shape.

3. The nonpowered treadmill of claim 2, wherein the resistance controller is configured to apply a variable force to at least one of the rotation unit and the track part in an opposite direction to a rotation direction of the track part while the track part is rotating.

4. The nonpowered treadmill of claim 3, wherein the rotation resistance of the track part is equal to or less than 2.0 kg force when the resistance controller applies no force.

5. The nonpowered treadmill of claim 4, wherein the rotation resistance of the track part is equal to or less than 1.0 kg force when the resistance controller applies no force.

6. The nonpowered treadmill of claim 1, wherein the resistance controller is configured to linearly decrease the rotation resistance of the track part.

7. The nonpowered treadmill of claim 3, wherein the resistance controller is configured to remove the variable force when the rotation speed of the track part is greater than a reference speed.

8. The nonpowered treadmill of claim 3, wherein the rotation unit comprises:

a plurality of first rotating members located in a front portion and a rear portion; and a plurality of second rotating members arranged between the plurality of first rotating members and having a smaller diameter than the plurality of first rotating members.

9. The nonpowered treadmill of claim 8, wherein the track part comprises a plurality of slats extending in a direction perpendicular to a rotation direction of the rotation unit.

10. The nonpowered treadmill of claim 9, further comprising a frame structure supporting the rotation unit, wherein the plurality of second rotating members are arranged in a curved line in an upper portion of the frame structure.

11. The nonpowered treadmill of claim 2, wherein the resistance controller is further configured to decrease the rotation resistance of the track part in response to the rotation speed of the track part being equal to or lower than a reference speed.

12. The noriltowerect treadmill of claim 11, wherein the reference speed is one of the following: a maximum walking speed of the user, a speed at which the user starts to walk or a maximum speed which the user can achieve on the track part.

13. The nonpowered treadmill of claim 2, wherein the resistance controller is further configured to maintain the rotation resistance of the track part at a minimum rotation resistance in response to the rotation speed of the track part being equal to or higher than a reference speed.

14. The nonpowered treadmill of claim 13, wherein the reference speed is one of the following: a maximum walking speed of the user, a speed at which the user starts to walk or a maximum speed which the user can achieve on the track part.

* * * * *